US009515412B1

(12) United States Patent
Yang et al.

(10) Patent No.: US 9,515,412 B1
(45) Date of Patent: Dec. 6, 2016

(54) CARD CONNECTOR

(71) Applicant: Cheng Uei Precision Industry Co., Ltd., New Taipei (TW)

(72) Inventors: Cheng-Wang Yang, Dong-Guan (CN); Chao-Yong Ye, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/095,157

(22) Filed: Apr. 10, 2016

(51) Int. Cl.
*H01R 13/648* (2006.01)
*H01R 13/506* (2006.01)
*H01R 13/405* (2006.01)

(52) U.S. Cl.
CPC ..... *H01R 13/506* (2013.01); *H01R 13/405* (2013.01)

(58) Field of Classification Search
CPC ..... H01R 13/6594
USPC ..... 439/607.31, 607.35–607.4, 607.53, 439/607.55
See application file for complete search history.

(56) References Cited

U.S. PATENT DOCUMENTS 6,736,676 B2 * 5/2004 Zhang ..... H01R 12/727 439/541.5
7,670,173 B2 * 3/2010 Hu ..... H01R 13/65802 439/541.5
7,731,534 B1 * 6/2010 Yuan ..... H01R 13/639 439/607.4
7,811,131 B2 * 10/2010 Wang ..... H01R 13/65802 439/607.35
8,353,728 B2 * 1/2013 Wang ..... H01R 12/721 439/637
8,858,237 B2 * 10/2014 Hsu ..... H01R 13/514 439/60
9,099,811 B2 * 8/2015 Simmel ..... H01R 13/64

* cited by examiner

*Primary Examiner* — Neil Abrams
(74) *Attorney, Agent, or Firm* — Cheng-Ju Chiang

(57) ABSTRACT

A card connector includes a first housing, terminals and a second housing. The first housing has a base portion, a front surface of the base portion forms a protruded portion, a rear surface of the base portion forms an extending portion. A front surface of the protruded portion forms an inserting chamber extended to the extending portion. The rear surface of the base portion defines a fixing cavity located below the extending portion. Terminal grooves are defined in a top wall of the fixing cavity and a bottom surface of the extending portion and communicates with the inserting chamber and the fixing cavity. The terminals include first terminals and second terminals integratedly molded in the second housing. The second housing with the first terminals and the second terminals are fixed in the fixing cavity. The first terminals and the second terminals pass through the terminal grooves and extending into the inserting chamber.

9 Claims, 6 Drawing Sheets

CARD CONNECTOR

BACKGROUND OF THE INVENTION

1. Field of the Invention

The present invention relates to a connector, and more particularly to a card connector.

2. The Related Art

A traditional card connector includes an insulating housing, a plurality of terminals and a shell. The insulating housing defines a plurality of terminal grooves. A plurality of terminals is mounted in the terminal grooves. The shell covers the insulating housing and the terminals.

However, in the process of mounting the terminals in the insulating housing, operator usually needs to mount the terminals one by one, which reduces the work efficiency and the terminals are easy to deformation.

SUMMARY OF THE INVENTION

An object of the present invention is to provide a card connector. The card connector includes a first housing, a first shell, a second shell, a plurality of terminals and a second housing. The first housing has a base portion, a middle of a front surface of the base portion protrudes frontward to form a protruded portion, a middle of a rear surface of the base portion protrudes rearward to form an extending portion. A front surface of the protruded portion is recessed rearward to form an inserting chamber extended to the extending portion. The rear surface of the base portion defines a fixing cavity located below the extending portion. A plurality of terminal grooves is defined in a top wall of the fixing cavity and a bottom surface of the extending portion and communicates with the inserting chamber and the fixing cavity. The first shell covers a periphery of the extending portion and two opposite sides of the base portion. The second shell covers a periphery of the base portion and the front surface of the base portion with the protruded portion exposed from an opening formed in the second shell, the second shell covers front portions of the first shell. The plurality of terminals includes a plurality of first terminals and a plurality of second terminals. The first terminals and the second terminals are integratedly molded in the second housing. The second housing with the first terminals and the second terminals are fixed in the fixing cavity of the first housing. The first terminals and the second terminals pass through the terminal grooves and extending into the inserting chamber.

As described above, the first terminals and the second terminals are integratedly molded in the second housing and further fixed in the fixing cavity of the first housing together with the second housing. Thus, the first terminals and the second terminals are more easily assembled and accurately positioned with the first housing and the second housing to prevent the deformation of the first terminals and the second terminals.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
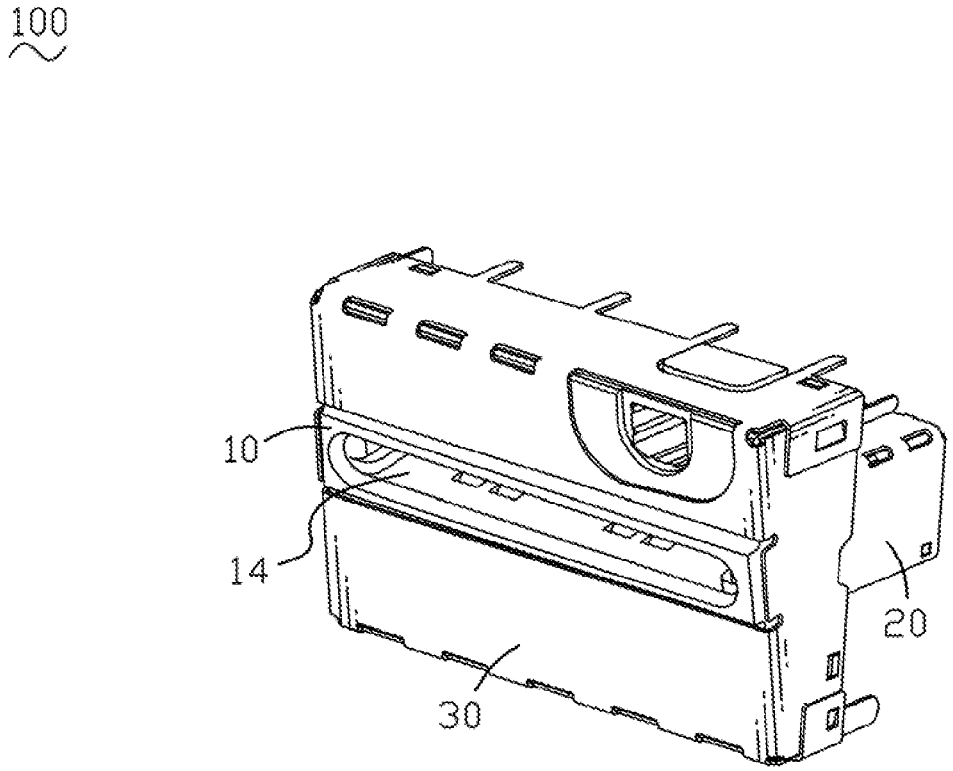
FIG. 1 is a perspective view of a card connector in accordance with an embodiment of the present invention.
Figure 2:
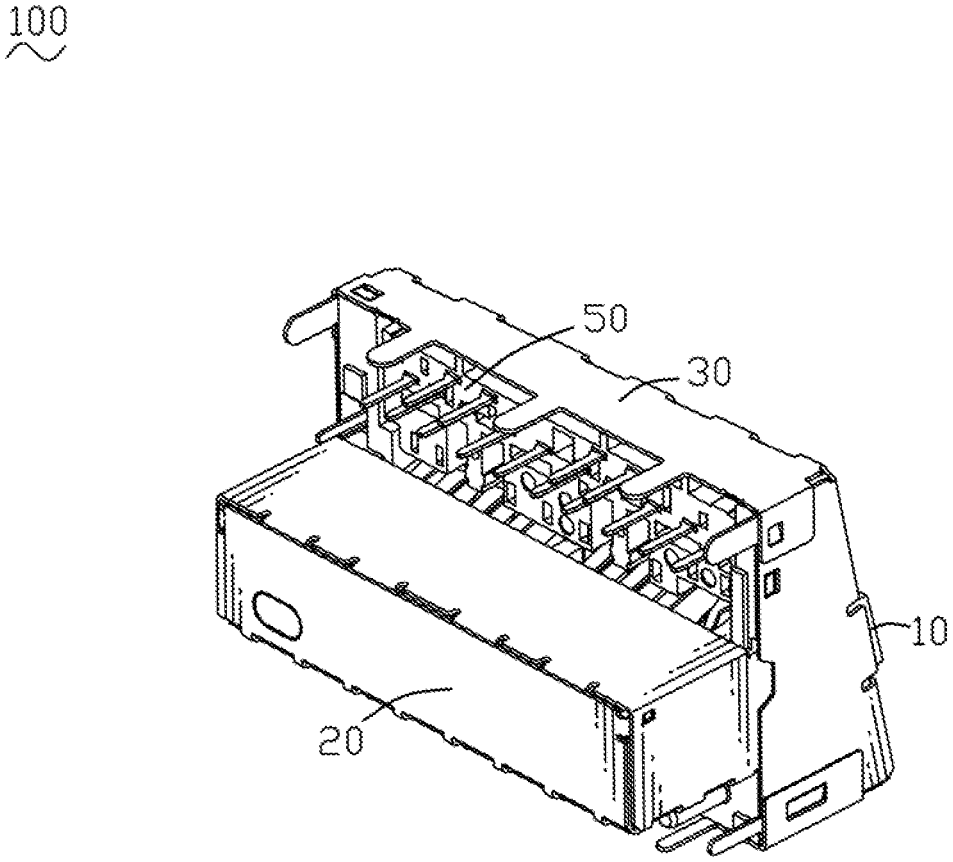
FIG. 2 is another perspective view of the card connector of FIG. 1.
Figure 3:
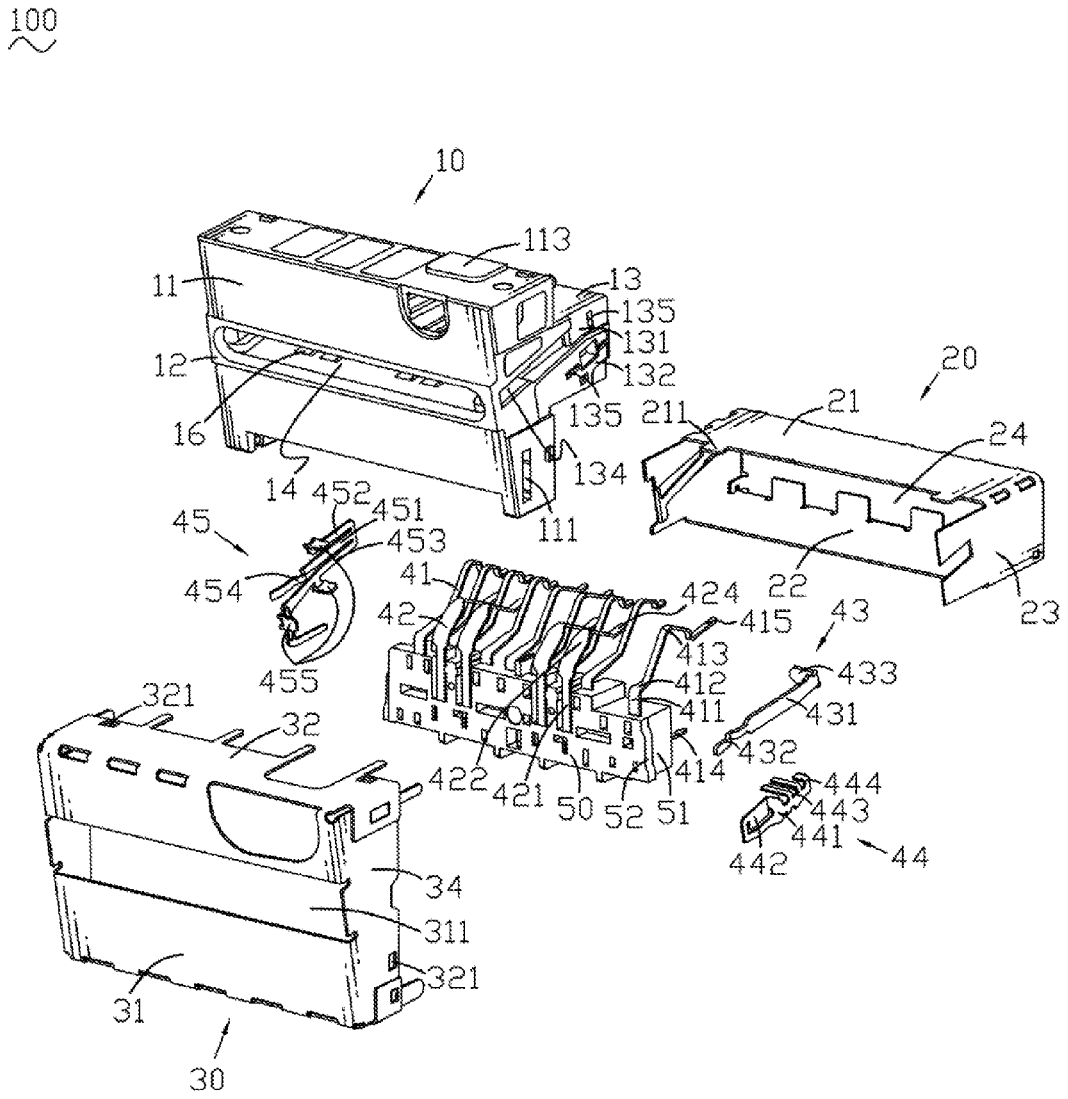
FIG. 3 is an exploded view of the card connector of FIG. 1.
Figure 4:
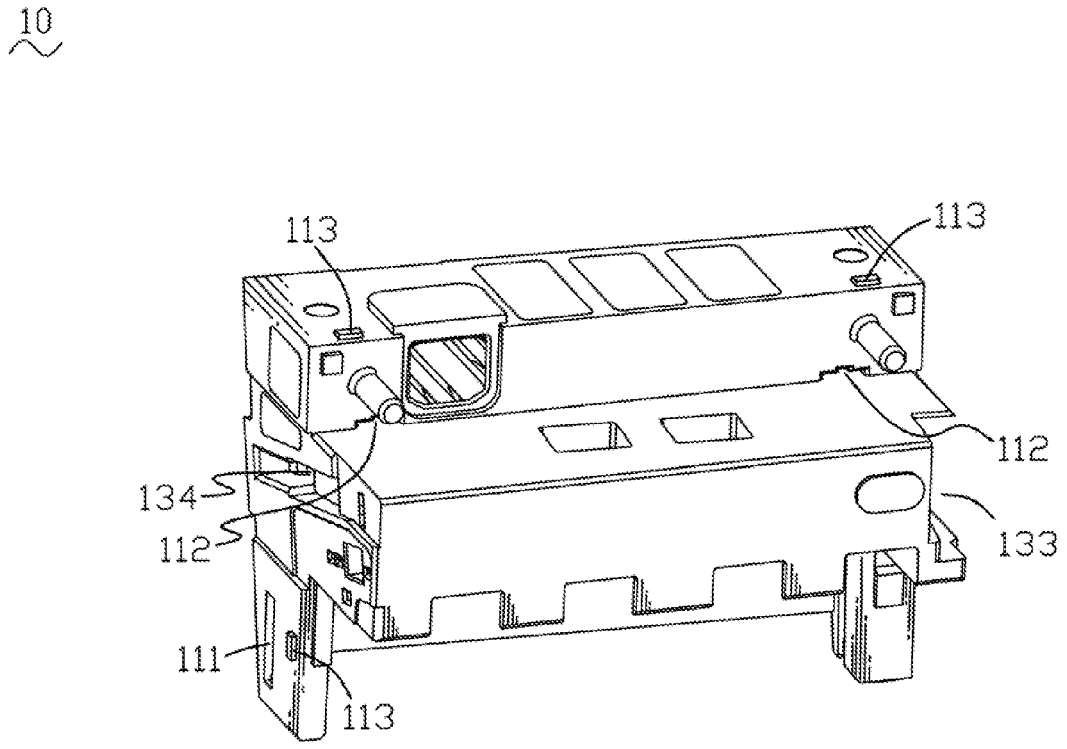
FIG. 4 is a perspective view of a first housing of the card connector of FIG. 1.
Figure 5:
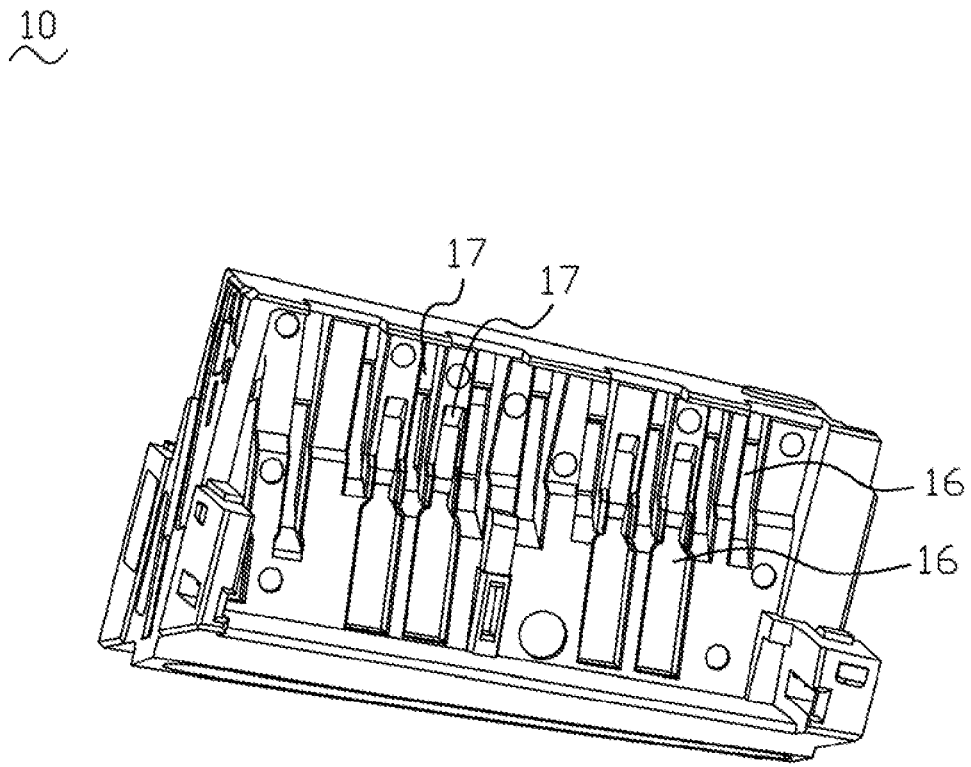
FIG. 5 is another perspective view of the first housing of FIG. 4.

With reference to FIGS. 1-3, a card connector 100 in accordance with an embodiment of the present invention is shown. The card connector 100 includes a first housing 10, a first shell 20, a second shell 30, a plurality of terminals (not labeled) and a second housing 50.

Referring to FIGS. 3-6, the first housing 10 has a base portion 11. A middle of a front surface of the base portion 11 protrudes frontward to form a protruded portion 12. A middle of a rear surface of the base portion 11 protrudes rearward to form an extending portion 13. A front surface of the protruded portion 12 defines an inserting chamber 14 extending to the extending portion 13. The rear surface of the base portion 11 defines a fixing cavity 15 located below the extending portion 13. A plurality of terminal grooves 16 are defined in a top wall of the fixing cavity 15 and a bottom surface of the extending portion 13 and communicate with the inserting chamber 14 and the fixing cavity 15. A rear wall of each of the terminal grooves 16 defines a blocking platform 17. In detail, the inserting chamber 14 is used for inserting storage card therein. Bottoms of two opposite sides of the base portion 11 define a pair of buckling slots 111, and the buckling slots 111 connect with the fixing cavity 15. The rear surface of the base portion 11 defines a pair of fastening slots 112 locating above the extending portion 13. A periphery of the base portion 11 protrudes outward to form a plurality of lumps 113. One side of the base portion 11 and the extending portion 13 defines a first receiving slot 131 and a second receiving slot 132 locating under the first receiving slot 131. The other side of the base portion 11 and the extending portion 13 defines a third receiving slot 133. Fronts of the first receiving slot 131 and the third receiving slot 133 are concaved inward to form a pair of connecting slots 134, and the connecting slots 134 connect with the inserting chamber 14. Inner walls of the first receiving slot 131, the second receiving slot 132 and the third receiving slot 133 define inserting slots 135.

The first shell 20 has a top plate 21, a bottom plate 22, two side plates 23 and a rear plate 24. The top plate 21, the bottom plate 22, the two side plates 23 and the rear plate 24 cover the extending portion 13, and fronts of the two side plates 23 exceed the top plate 21 and the bottom plate 22 and respectively cover the two opposite sides of the base portion 11. Two sides of a front end of the top plate 21 protrude frontward to form a pair of fastening plates 211. The fastening plates 211 are fixed in the fastening slots 112 of the base portion 11 of the first housing 10.

The second shell 30 has a front board 31, a top board 32, a bottom board 33 and two side boards 34. The front board 31, the top board 32, the bottom board 33 and the two side boards 34 cover the base portion 11, and fronts of the two side boards 34 respectively cover two opposite sides of protruded portion 12. The two side boards 34 cover the fronts of two side plates 23 of the first shell 20. The front board 31 has an opening 311 from which the protruded portion 12 exposed. The top board 31, the bottom board 32 and the two side boards 34 define a plurality of notches 321.

The lumps 113 of the base portion 11 of the first housing 10 are respectively buckled in the notches 321.

Figure 6:
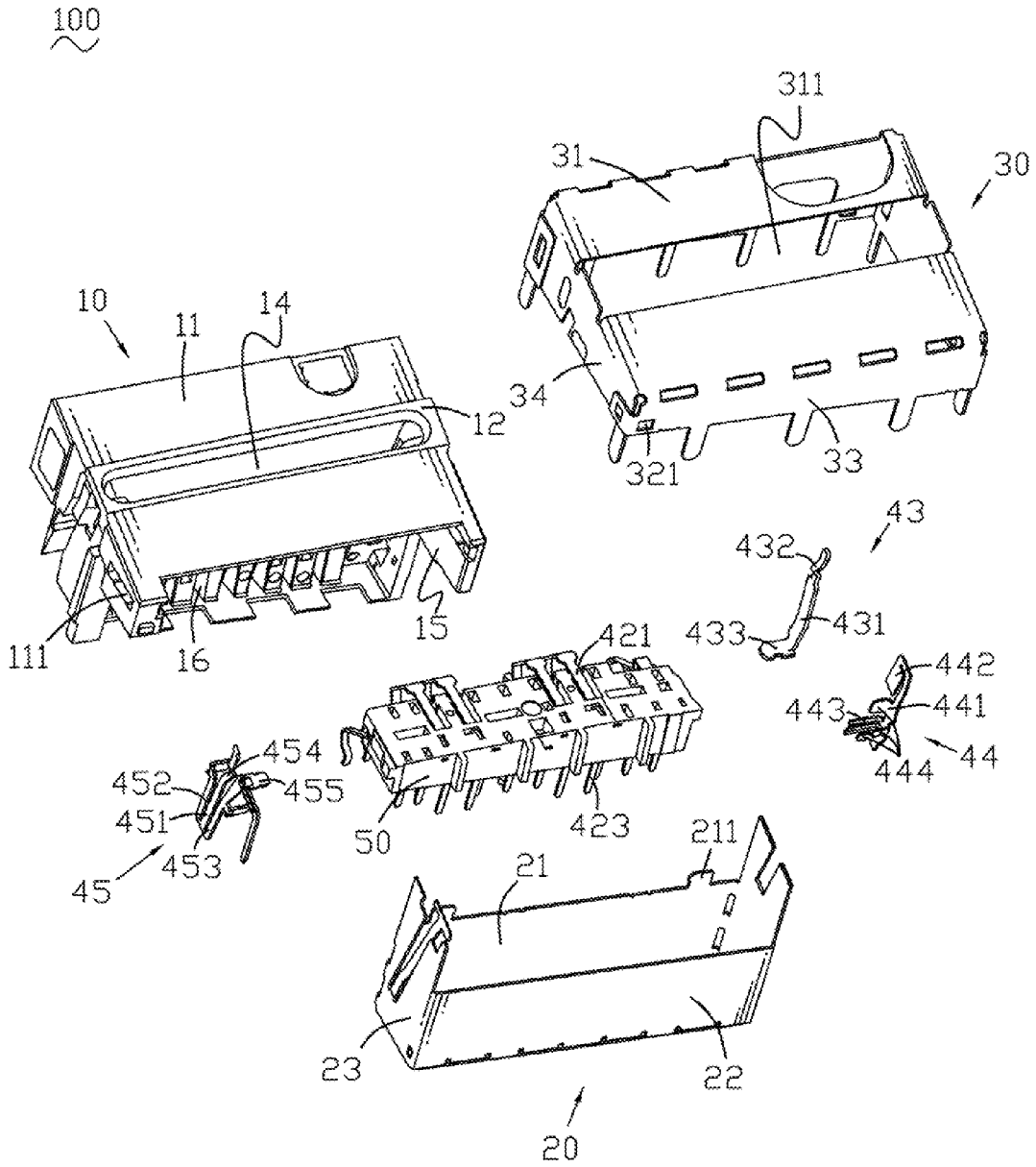
FIG. 6 is another exploded view of the card connector of FIG. 1.

Referring to FIG. 3 and FIG. 6, the terminals include a plurality of first terminals 41, a plurality of second terminals 42, a third terminal 43, a fourth terminal 44 and a fifth terminal 45.

In detail, each of the first terminals 41 has a first fastening strip 411. A top end of the first fastening strip 411 is bent rearward to form a first bending portion 412. A tail end of the first bending portion 412 extends rearward and slants upward and then extends rearward and slants downward to form a first contact portion 413. A bottom end of the first fastening strip 411 is bent rearward to form a first soldering portion 414. A tail end of the first contact portion 413 further extends rearward to form a first blocking portion 415.

Each of the second terminals 42 has a second fastening strip 421. A top end of the second fastening strip 421 extends rearward and slants upward and then extends rearward and slants downward to form a second contact portion 422. A bottom end of the second fastening strip 421 is bent rearward to form a second soldering portion 423. A tail end of the second contact portion 422 extends rearward to form a second blocking portion 424.

The third terminal 43 has a third fastening strip 431. A front of the third fastening strip 431 is arced inward to form a third contact portion 432. A rear end of the third fastening strip 431 is bent inward to form a first buckling portion 433.

The fourth terminal 44 has a fourth fastening strip 441. A front end of the fourth fastening strip 441 protrudes upward and then rearward to form a second bending portion 442. A middle of a top of the fourth fastening strip 441 is bent inward to form a plurality of fourth contact portions 443. Two sides of the fourth fastening strip 441 are bent inward to form a plurality of second buckling portions 444.

The fifth terminal 45 has a first fixing foot 451. A rear end of the first fixing foot 451 protrudes upward and then frontward to form a second fixing foot 452. A rear end of the first fixing foot 451 protrudes downward and then frontward to form a third fixing foot 453. A front end of the first fixing foot 451 is arced inward to form a fifth contact portion 454. A front end of the second fixing foot 452 and a periphery of the third fixing foot 453 are bent inward to form a plurality of third buckling portions 455.

The second housing 50 has a base body 51. Two opposite sides of the base body 51 protrude outward to form a pair of buckling ears 52.

Referring to FIGS. 1-6, the first terminals 41 and the second terminals 42 are arranged in two rows in transverse direction and then molded in the second housing 50. In detail, lower portions of the first fastening strips 411 of the first terminals 41 and lower portions of the second fastening strips 421 of the second terminals 42 are molded in the base body 51 of the second housing 50. Rears of the first soldering portions 414 of the first terminals 41 and the second soldering portions 423 of the second terminals 42 project beyond a rear surface of the base body 51 of the second housing 50.

The second housing 50 with the first terminals 41 and the second terminals 42 are buckled in the fixing cavity 15 of the first housing 10. The buckling ears 52 are respectively buckled in the buckling slots 111 of the base portion 11 of the first housing 10. The first contact portions 413 of the first terminals 41 and the second contact portions 422 of the second terminals 42 pass through the terminal grooves 16 and project into the inserting chamber 14 of the first housing 10. The heights of the first contact portions 413 are higher than the heights of the second contact portions 422. The first blocking portions 415 of the first terminals 42 and the second blocking portion 424 of the second terminals 42 resist against bottom faces of the blocking platforms 17 of the first housing 10.

The third terminal 43 is received in the first receiving slot 131. The fourth terminal 44 is received in the second receiving slot 132. The fifth terminal 45 is received in the third receiving slot 133. In detail, the third contact portion 432 of the third terminal 43 and the fifth contact portion 454 of the fifth terminal 45 pass through the connecting slots 134 and project into the inserting chamber 14 of the first housing 10. The fourth contact portion 443 of the fourth terminal 44 is located under outermost one of the first contact portions 413. The first buckling portion 433, the second buckling portions 444 and the third buckling portions 455 are buckled in the inserting slots 135.

The first shell 20 covers the extending portion 13 and the two opposite sides of the base portion 11 of the first housing 10. The fastening plates 211 of the first shell 20 are fixed in the fastening slots 112 of the first housing 10.

The second shell 30 covers the fronts of the two side plates 23 of the first shell 20, the base portion 11 and the two opposite sides of the protruded portion 12 of the first housing 10. The lumps 113 of the first housing 10 are buckled in the notches 321 of the second shell 30.

As described above, the first terminals 41 and the second terminals 42 are integratedly molded in the second housing 50 and further buckled in the fixing cavity 15 of the first housing 10 together with the second housing 50. Thus, the first terminals 41 and the second terminals 42 are more easily assembled and accurately positioned with the first housing 10 and the second housing 50 to prevent the deformation of the first terminals 41 and the second terminals 42.

What is claimed is:

1. A card connector, comprising:

a first housing having a base portion, a middle of a front surface of the base portion protruding frontward to form a protruded portion, a middle of a rear surface of the base portion protruding rearward to form an extending portion, a front surface of the protruded portion being recessed rearward to form an inserting chamber extended to the extending portion, the rear surface of the base portion defining a fixing cavity located below the extending portion, a plurality of terminal grooves being defined in a top wall of the fixing cavity and a bottom surface of the extending portion and communicating with the inserting chamber and the fixing cavity;

a first shell surrounding a periphery of the extending portion and covering two opposite sides of the base portion;

a second shell surrounding a periphery of the base portion and covering the front surface of the base portion with the protruded portion exposed from an opening formed in the second shell, the second shell covering front portions of the first shell;

a plurality of terminals including a plurality of first terminals and a plurality of second terminals; and a second housing;

wherein the first terminals and the second terminals are integratedly molded in the second housing, and the second housing with the first terminals and the second terminals are fixed in the fixing cavity of the first housing, the first terminals and the second terminals pass through the terminal grooves and extending into the inserting chamber.

2. The card connector as claimed in claim 1, wherein the first terminals are molded in a rear of the second housing and arranged transversely and the second terminals are molded in a front of the second housing and arranged transversely.

3. The card connector as claimed in claim 2, wherein each of the first terminals has a first fastening strip, a top end of the first fastening strip is bent rearward to form a first bending portion, a tail end of the first bending portion extends rearward and slants upward and then extends rearward and slants downward to form a first contact portion, a bottom end of the first fastening strip is bent rearward to form a first soldering portion; each of the second terminals has a second fastening strip, a top end of the second fastening strip extends rearward and slants upward and then extends rearward and slants downward to form a second contact portion, a bottom end of the second fastening strip is bent rearward to form a second soldering portion, lower portions of the first fastening strips of the first terminals and the second fastening strips of the second terminals are molded in the second housing, rears of the first soldering portions of the first terminals and the second soldering portions of the second terminals project beyond a rear surface of the second housing.

4. The card connector as claimed in claim 3, wherein a rear wall of each of the terminal grooves protrudes inward to form a blocking platform, a tail end of the first contact portion extends rearward to form a first blocking portion, a tail end of the second contact portion extends rearward to form a second blocking portion, the first blocking portions of the first terminals and the second blocking portions of the second terminals resist against bottoms of the respective blocking platforms of the first housing.

5. The card connector as claimed in claim 3, wherein the heights of the first contact portions are higher than the heights of the second contact portions.

6. The card connector as claimed in claim 1, wherein bottoms of the two opposite sides of the base portion define a pair of buckling slots communicating with the fixing cavity, the second housing has a base body, two opposite sides of the base body protrude outward to form a pair of buckling ears, the buckling ears are respectively buckled in the buckling slots of the base portion of the first housing.

7. The card connector as claimed in claim 1, wherein the rear surface of the base portion defines two fastening slots locating above the extending portion, a periphery of the base portion protrudes outward to form a plurality of lumps, the first shell has a top plate, a bottom plate, two side plates and a rear plate, the top plate, the bottom plate, the two side plates and the rear plate cover the extending portion, and fronts of two side plates exceed the top plate and the bottom plate and respectively cover the two opposite sides of the base portion, two sides of a front end of the top plate protrude frontward to form two fastening plates, the fastening plates are fixed in the fastening slots of the base portion of the first housing, the second shell has a front board, a top board, a bottom board and two side boards, the front board, the top board, the bottom board and the two side boards cover the base portion, and fronts of the two side boards respectively cover two opposite sides of the protruded portion, the two side boards cover the fronts of two side plates of the first shell, the top board, the bottom board and the two side boards define a plurality of notches, the lumps of the base portion of first housing are respectively buckled in the notches.

8. The card connector as claimed in claim 1, wherein one of two opposite sides of the extending portion defines a first receiving slot and a second receiving slot located below the first receiving slot, the other of the two opposite sides of the extending portion defines a third receiving slot, the first receiving slot and the third receiving slot are extended to the two opposite sides of the base portion, the terminals further includes a third terminal, a fourth terminal and a fifth terminal, the third terminal is received in the first receiving slot, the fourth terminal is received in the second receiving slot, the fifth terminal is received in the third receiving slot.

9. The card connector as claimed in claim 8, wherein fronts of the first receiving slot and the third receiving slot are concaved inward to form connecting slots, and the connecting slots connect with the inserting chamber, the first receiving slot, the second receiving slot and the third receiving slot define inserting slots, the third terminal has a third fastening strip, a front of the third fastening strip is arced inward to form a third contact portion, a rear end of the third fastening strip is bent inward to form a first buckling portion, the fourth terminal has a fourth fastening strip, a front end of the fourth fastening strip protrudes upward and then rearward to form a second bending portion, a middle of a top of the fourth fastening strip is bent inward to form a plurality of fourth contact portions, two sides of the top of the fourth fastening strip are bent inward to form a plurality of second buckling portions, the fifth terminal has a first fixing foot, a rear end of the first fixing foot protrudes upward and then frontward to form a second fixing foot, the rear end of the first fixing foot protrudes downward and then frontward to form a third fixing foot, a front end of the first fixing foot is arced inward to form a fifth contact portion, a front end of the second fixing foot and a periphery of the third fixing foot are bent inward to form a plurality of third buckling portions, the third contact portion of the third terminal and the fifth contact portion of the fifth terminal pass through the connecting slots and project into the inserting chamber of the first housing, the fourth contact portions of the fourth terminal are located under the first contact portion of outermost one of the first terminals, the first buckling portion, the second buckling portions and the third buckling portions are buckled in the inserting slots.

* * * * *